US005480594A

United States Patent [19]

Wilkerson et al.

[11] Patent Number: 5,480,594

[45] Date of Patent: Jan. 2, 1996

[54] METHOD AND APPARATUS FOR DISTRIBUTING AIR THROUGH A COOLING TOWER

[76] Inventors: H. Joe Wilkerson, 11628 Gates Mill Dr., Knoxville, Tenn. 37922; Dudley J. Benton, 1611 Hightop Trail, Knoxville, Tenn. 37923

[21] Appl. No.: 300,155

[22] Filed: Sep. 2, 1994

[51] Int. Cl.[6] ..... B01F 3/04

[52] U.S. Cl. ..... 261/109; 261/DIG. 11

[58] Field of Search ..... 261/109, DIG. 11

[56] References Cited

U.S. PATENT DOCUMENTS

| | | | |
|---|---|---|---|
| 2,394,755 | 2/1946 | De Flon | 261/109 |
| 3,400,917 | 9/1968 | Richards . | |
| 3,411,758 | 11/1968 | Edmondson . | |
| 3,434,700 | 3/1969 | Sexton et al. . | |
| 3,776,306 | 12/1973 | Michel . | |
| 4,148,850 | 4/1979 | Schulte et al. | 261/109 |
| 4,157,368 | 6/1979 | Fernandes . | |
| 4,267,883 | 5/1981 | Maurice et al. . | |
| 4,278,620 | 7/1981 | Lefevre . | |
| 4,397,793 | 8/1983 | Stillman et al. . | |
| 4,499,034 | 2/1985 | McAllister, Jr. . | |
| 4,737,321 | 4/1988 | McCloskey et al. | 261/109 |

FOREIGN PATENT DOCUMENTS

| | | |
|---|---|---|
| 142332 | 7/1903 | Germany . |
| 567196 | 12/1932 | Germany . |

*Primary Examiner*—Tim R. Miles
*Attorney, Agent, or Firm*—Luedeka, Neely & Graham

[57] ABSTRACT

Natural draft water cooling tower heat transfer efficiency is improved by an inlet air flow baffle to divide the inlet cooling air between a first volumetric flow portion channeled directly to the axial core of the tower draft channel under a shielded protection from a water droplet dispersion of descending process water and a second volumetric flow portion of inlet cooling air to an outer annulus of the draft channel surrounding the axial core.

11 Claims, 7 Drawing Sheets

METHOD AND APPARATUS FOR DISTRIBUTING AIR THROUGH A COOLING TOWER

FIELD OF THE INVENTION

This invention relates to the field of natural draft and some forced draft cooling towers for the cooling of liquid, generally water, and more particularly to an air distribution baffle for more effectively cooling water in the axial core of the tower draft channel.

BACKGROUND OF THE INVENTION

Large cooling towers, such as those used by power plants, are used to cool water by convective, counter flow, direct heat transfer with a rising air column. Typical cooling towers, vertical axis upflow venturis constructed of concrete, are elevated on columns providing a circular, horizontal entrance area at the base of the venturi draft channel of about 300 ft. to 350 ft. in diameter that enables air to flow horizontally in under the elevated entrance area and rise upward to the open top area of the tower.

Typically within the lower third of the 400 ft. to 500 ft. high venturi draft channel axial length (height) and across the 300 ft. to 350 ft. draft channel horizontal entrance section, a 10 ft. to 20 ft. thick section of porous fill material is provided to receive a sprayed distribution of the hot process water to be cooled by the tower. This fill material usually is thin plastic membrane formed in packed bundles of vertically disposed, small diameter tubes similar to a honeycomb structure. Water sprayed over the top face plane of the fill attaches to the tube walls as a thin liquid film, flowing downwardly while air rising through the open space within the tubes convectively extracts the water carried heat. As the air absorbs heat, it expands to reduce the specific density thereby buoyantly rising while fresh, cooler and more dense air flows from below to fill the evacuation, be heated and continue the open cycle.

From the lower face of the porous fill material, the cooled process water falls in the manner of a heavy rain over a vertical height of about 50 feet into a collecting basin. Through this heavy rain, fresh atmospheric air is first drawn laterally by the lower end of a low pressure axial column of rising air. As the laterally flowing air penetrates the rain, residual heat in the rain water transfers to the cooler air thereby beginning the air flow turn up the venturi draft channel.

Although very efficient, the aforedescribed structure and system remains with considerable opportunity for improvement due to an uneven water temperature gradient across the draft channel suction. Water falling into the basin from around the outer rim annulus of the draft channel is substantially cooler than water falling along an axially central column. As supply air radially penetrates the cylindrical cross-section volume beneath the lower venturi rim from the exterior perimeter, the rainfall restricts, heats and slows the radial air flow which results in a disproportionate loading of the incoming air heat absorption capacity with outer rim heat, thereby leaving the central core of the venturi with a smaller heat exchange differential between the air and water. The final temperature of process water falling into the basin from a central core area is hotter than the water falling from the outer perimeter.

It is therefore, an object of the present invention to provide a protective air flow shield which permits a predetermined proportion of fresh atmospheric air to penetrate the falling water zone of a natural draft cooling tower and reach the internal core of the draft channel without having to overcome outer perimeter rain resistance and heating thereby providing additional cooling and lower exit water temperatures.

Another object of the present invention is to lower the average temperature of cooled process water from the basin of a natural draft cooling tower.

Another object of the present invention is to provide a smaller variation in the range of cooled process water temperatures entering the basin of a natural draft cooling tower.

Another object of the present invention is to increase the overall thermal efficiency of a power production facility associated with a natural draft cooling tower.

Another object of the present invention is to provide a reduced heat rate (BTU/kw-hr.) of a power production facility associated with a natural draft cooling tower.

Another object of the present invention is to reduce the environmental impact of power production facilities due to increased thermal efficiency and correspondingly decreased heat rate.

Another object of the present invention is to provide a natural draft cooling tower with increased process water flow rate capacity for a given exit water temperature.

Another object of the present invention is to provide a device that is readily retrofittable to existing cooling towers.

A still further object of the present invention is to provide increased cooling air flow rates for natural draft cooling towers by reducing the cooling air pressure losses and the highest exit air temperatures.

SUMMARY OF THE INVENTION

These and other objects of the invention are served by a generally annular shaped air baffle and rain shield structure located in the substantially cylindrical volume space beneath the vertical draft channel of a natural or forced draft cooling tower. This annular baffle structure sweeps from a substantially horizontal perimeter beneath the cooling tower shell, at a level of 15% to 50% of the atmospheric air flow inlet height, to a substantially vertically standing central aperture having a diameter of about 40% to 60% of the draft channel entrance diameter.

Such baffle structure serves to divide the volume of cooling air inlet flow between an outer perimeter volume and an inner core volume. That cooling air flow dedicated to the inner core volume of the venturi draft channel is protected by the baffle from flow resistance posed by the outer annulus rainfall. The baffle shields the horizontal entrance run of the inner core cooling air from the outer perimeter annulus of rainfall. Outer annulus water falling upon the shield is channeled into radially aligned, rivulets of falling water which have little obstructive influence on the inner core cooling air flow.

In a preferred embodiment of the invention, construction of the baffle is as a tent-like, inverted funnel fabricated of woven fabric or reinforced plastic film. A circular beam structure of about half the tower draft channel inlet diameter is constructed to support the interior perimeter of the baffle at a height near the bottom plane of the porous fill material. This circular beam may be supported by vertical columns from below or suspended by cables from the tower wall.

A multiplicity of equiangularly spaced baffle support cables are secured at one end to and around the beam circle. The other ends of these cables are drawn in vertical radial planes to a near horizontal anchor level of 15% to 50% of the distance between the catch basin rim and the lower venturi rim. The baffle material is secured to these cables to define an approximate hyperboloid of revolution with gore sections between the beam cables. Along lines between the support cables, the tent material is drained of accumulated water through button-hole shaped vents. The collected drainage falls across the center cooling air flow section in readily aligned rivulets.

DESCRIPTION OF THE PREFERRED EMBODIMENTS

Figure 1:
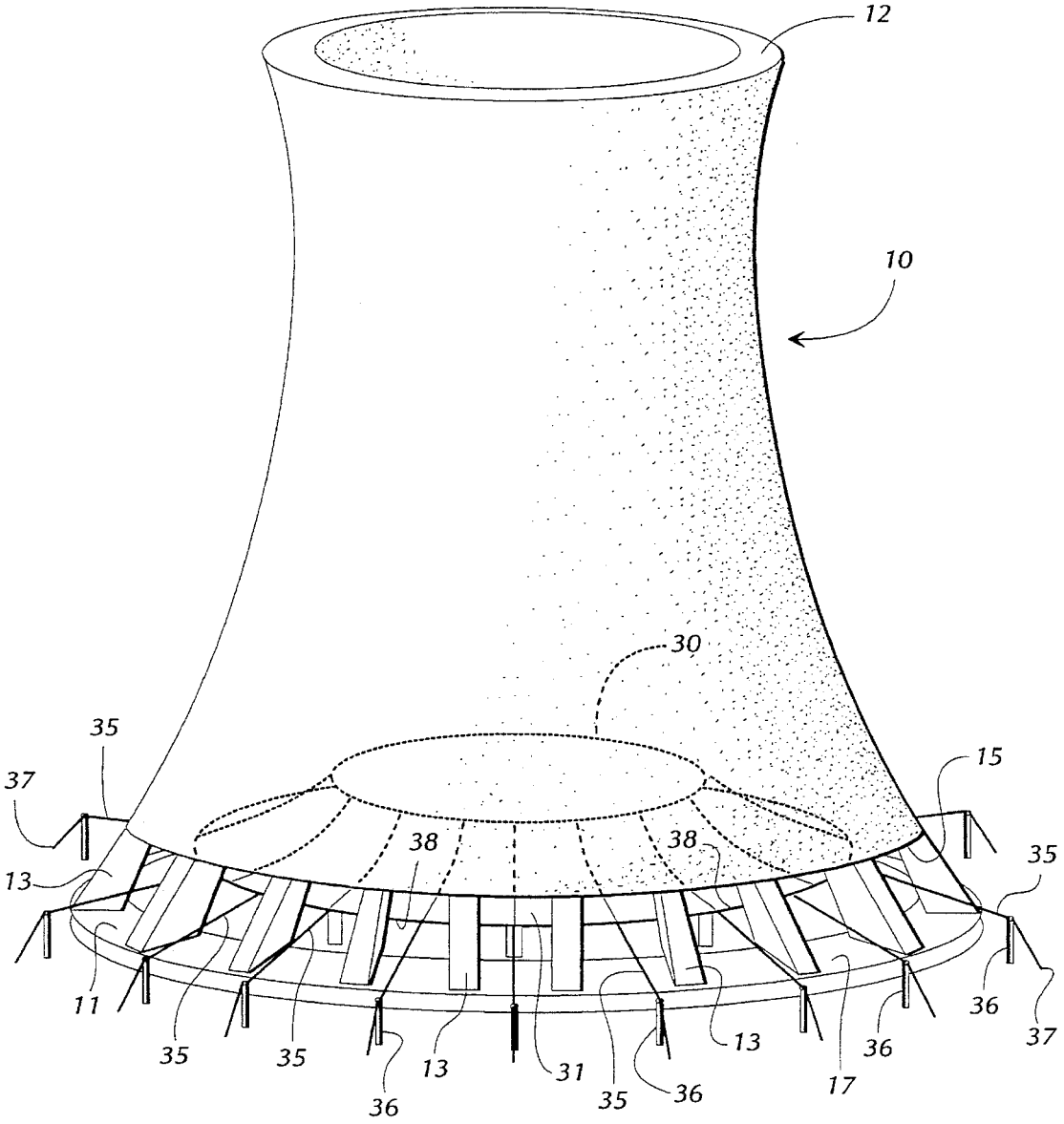
FIG. 1 is a simulated and simplified pictorial elevation of a cooling tower viewed along a downward sightline of approximately 10° below the horizontal showing the baffle/rain-shield in place.
Figure 2:
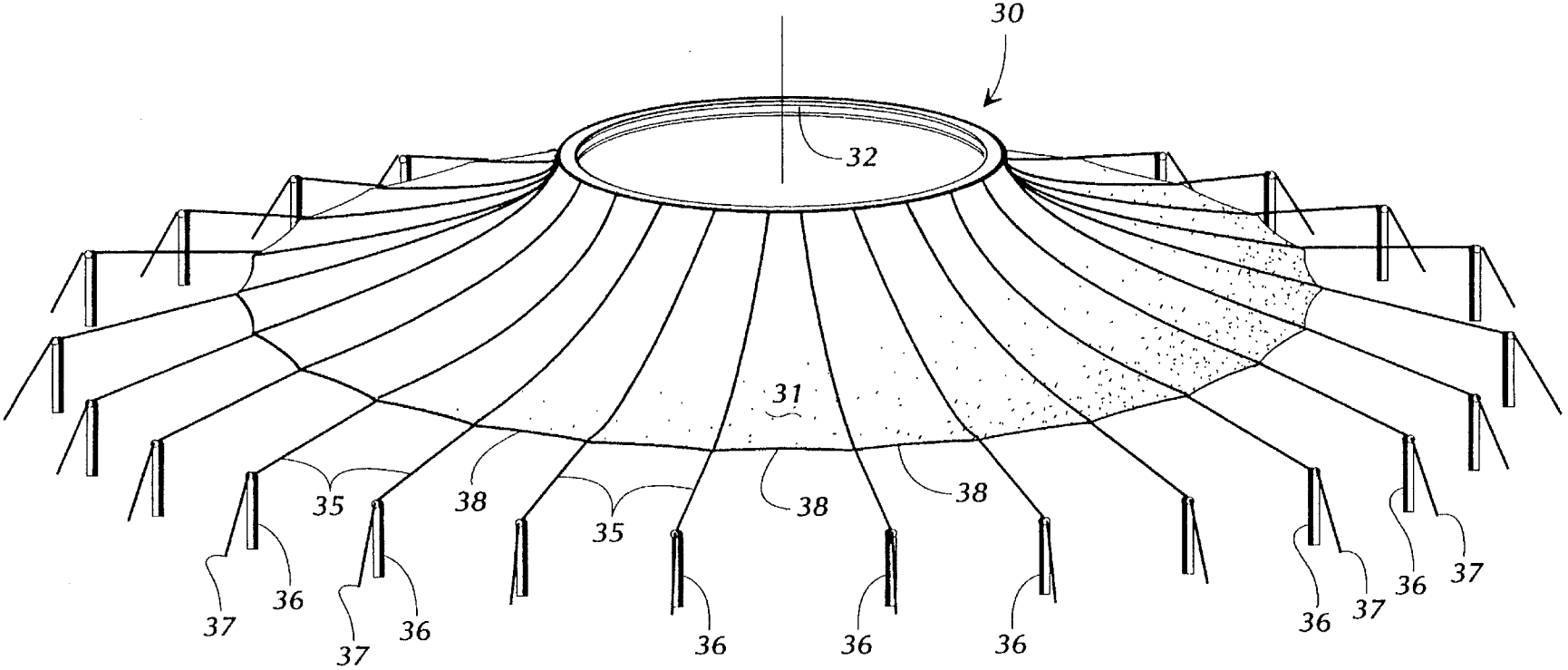
FIG. 2 is a simulated and simplified pictorial elevation of the baffle/rain-shield viewed along a downward sightline of approximately 10° below the horizontal.

Referring now to the drawings wherein like reference characters designate like or similar elements throughout the several figures of the drawings, FIG. 1 pictorially illustrates a state-of-art natural draft, counterflow, water cooling tower 10. This tower is a vertical axis venturi chimney of 400 ft. to 500 ft. height and 300 ft. to 350 ft. horizontally across the foundation footer 11. Typically, the venturi wall or shell 12 is fabricated of reinforced concrete cast in situ upon a multiplicity of concrete columns 13 secured to the circular foundation footer 11.

Figure 6:
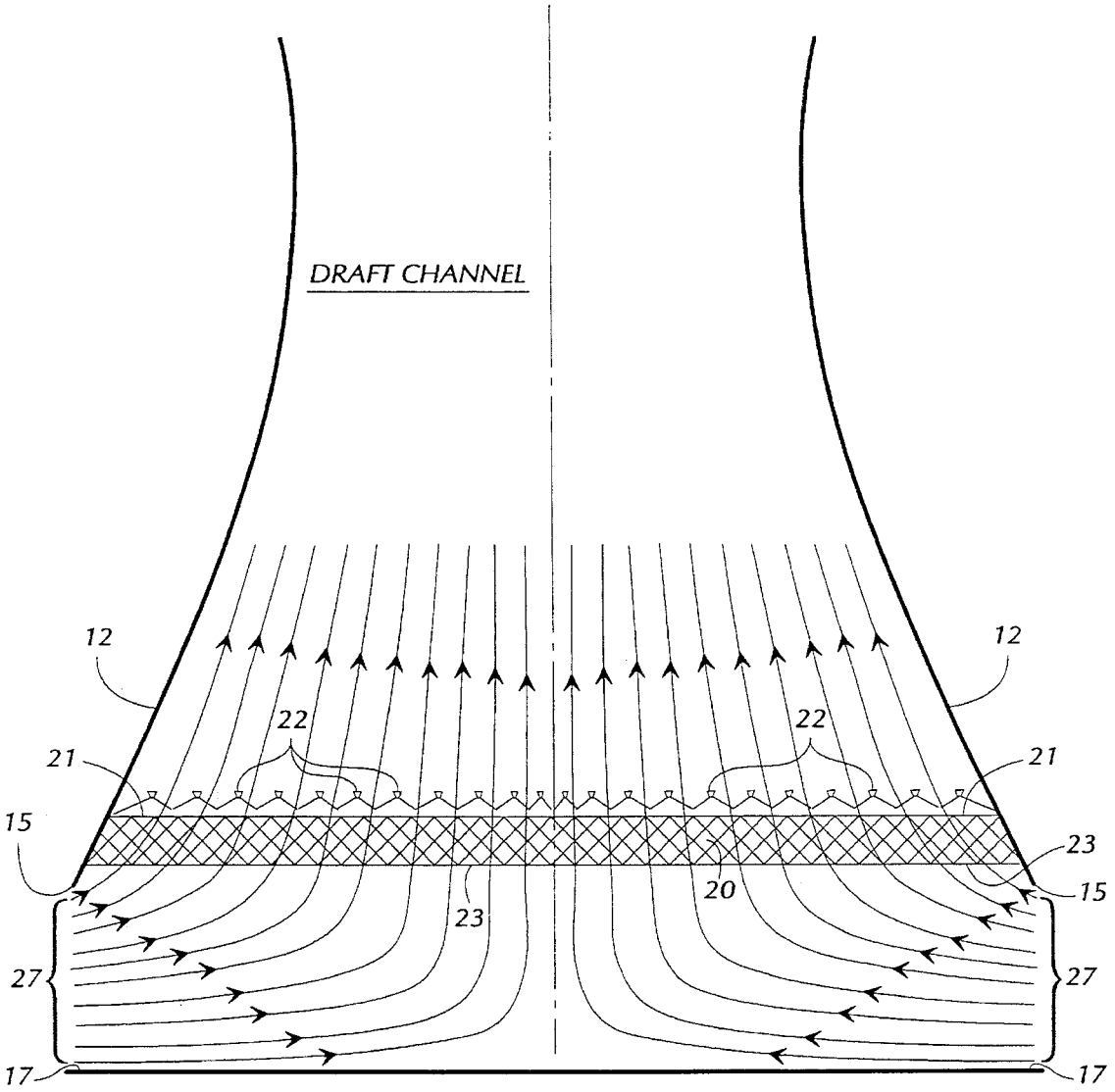
FIG. 6 is an air flow schematic illustrating air flow through a state-of-art cooling tower not equipped with a baffle/rain-shield.

The base plane 15 of the venturi shell 12 is supported by the columns 13 about 40 ft. to 60 ft. above the footer rim 17 thereby providing air entrance area, laterally, between the columns 13 and, vertically, between shell base plane 15 and footer rim 17. This air entrance area serves a substantially cylindrical air inlet volume under the circular area of the draft channel entrance in the shell base plane 15. As seen from the streamlines 27 of FIG. 6, this air inlet volume realigns the flow direction of incoming cooling air from horizontal between the shell base 15 and the footer rim 17. Within this volume, the inlet air density is initially reduced by direct cross-flow heat exchange with free falling droplets of cooling water.

Figure 3:
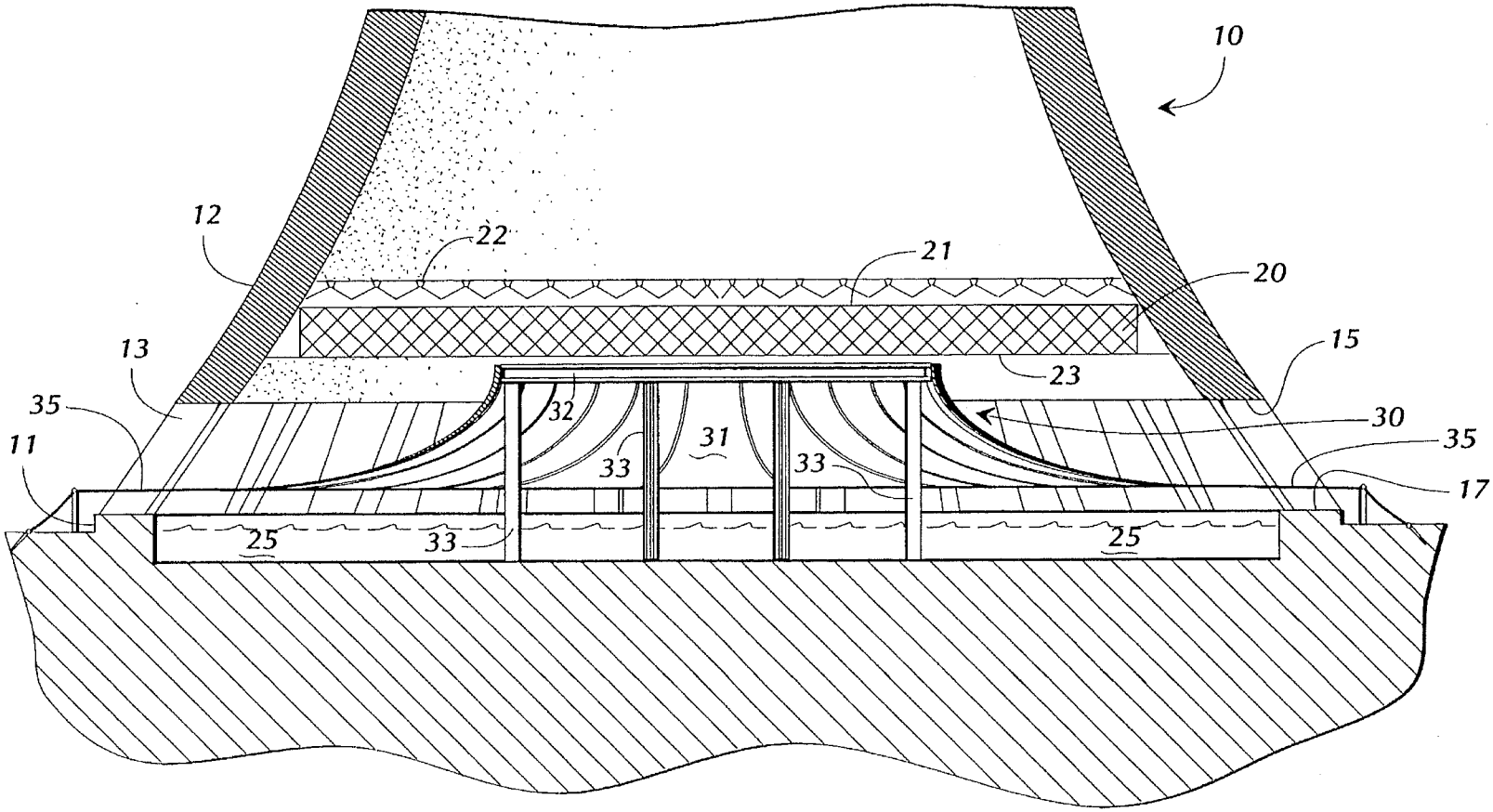
FIG. 3 is a sectioned elevational view of the bottom portion of a cooling tower with the baffle/rain-shield in place.

Above the air inlet volume as illustrated by FIG. 3, is a 10 ft. to 20 ft. thick section of gas/liquid film contacting section 20 called "fill". Such fill is comprised of a honeycomb-like matrix of small air passages having surrounding walls that are wetted by a continuous film flow of cooling water. Water spray distribution system 22 above the upper face plane 21 of the fill 20 distributes the hot process water supply flow across the top of the fill 20 for gravity drainage through the fill pore matrix.

Figure 4:
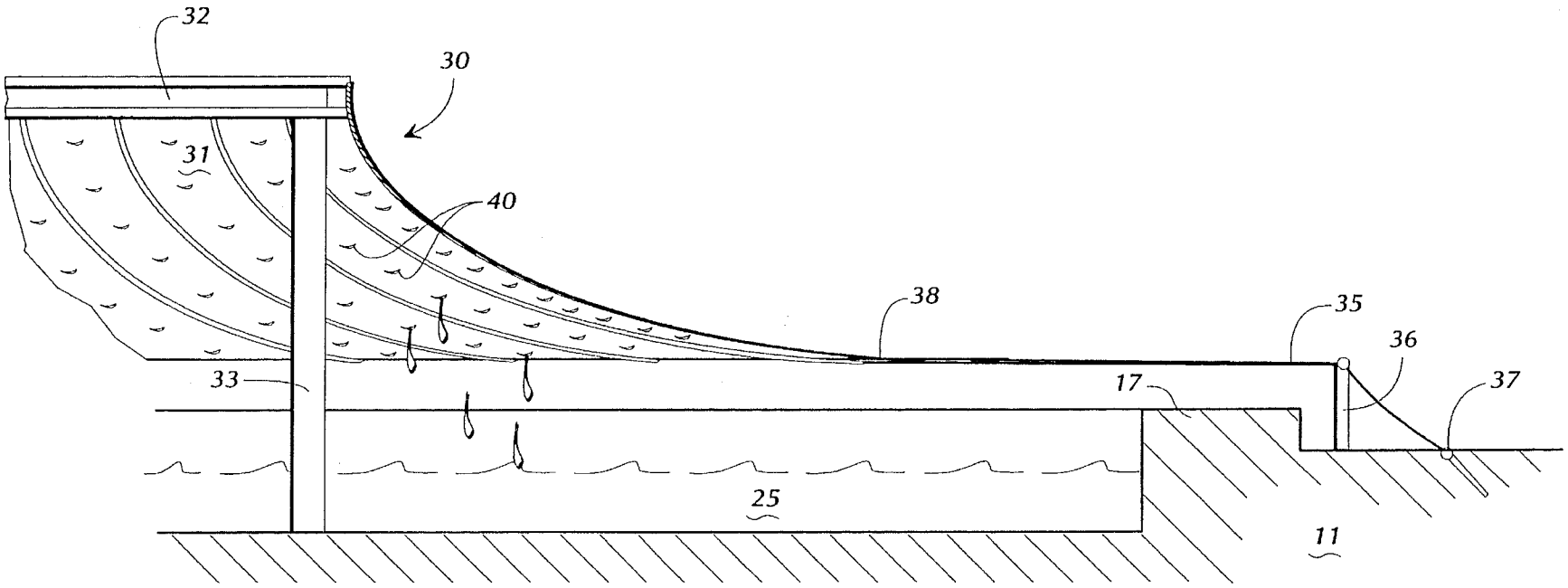
FIG. 4 is a sectioned elevational view of the baffle/rain-shield showing the water flow streams through apertures in the baffle/rain-shield fabric.

The water sprayed upon the upper face 21 of the fill 20 falls from the fill bottom face 23 in the manner of a heavy rainfall. This rainfall crosses the air inlet volume under the shell base 15 for collection into a relatively shallow basin 25 (FIG. 4). As the rain falls, it does so in direct, heat exchange contact with horizontally flowing entrance air 27, FIG. 6. Consequently, the cooler entrance air absorbs heat from the warmer rain which, resultantly, reduces the specific density of such entrance air. Hence, the air buoyantly rises to turn the flow upward into the fill pores for more effective direct heat transfer and velocity acceleration.

Figure 7:
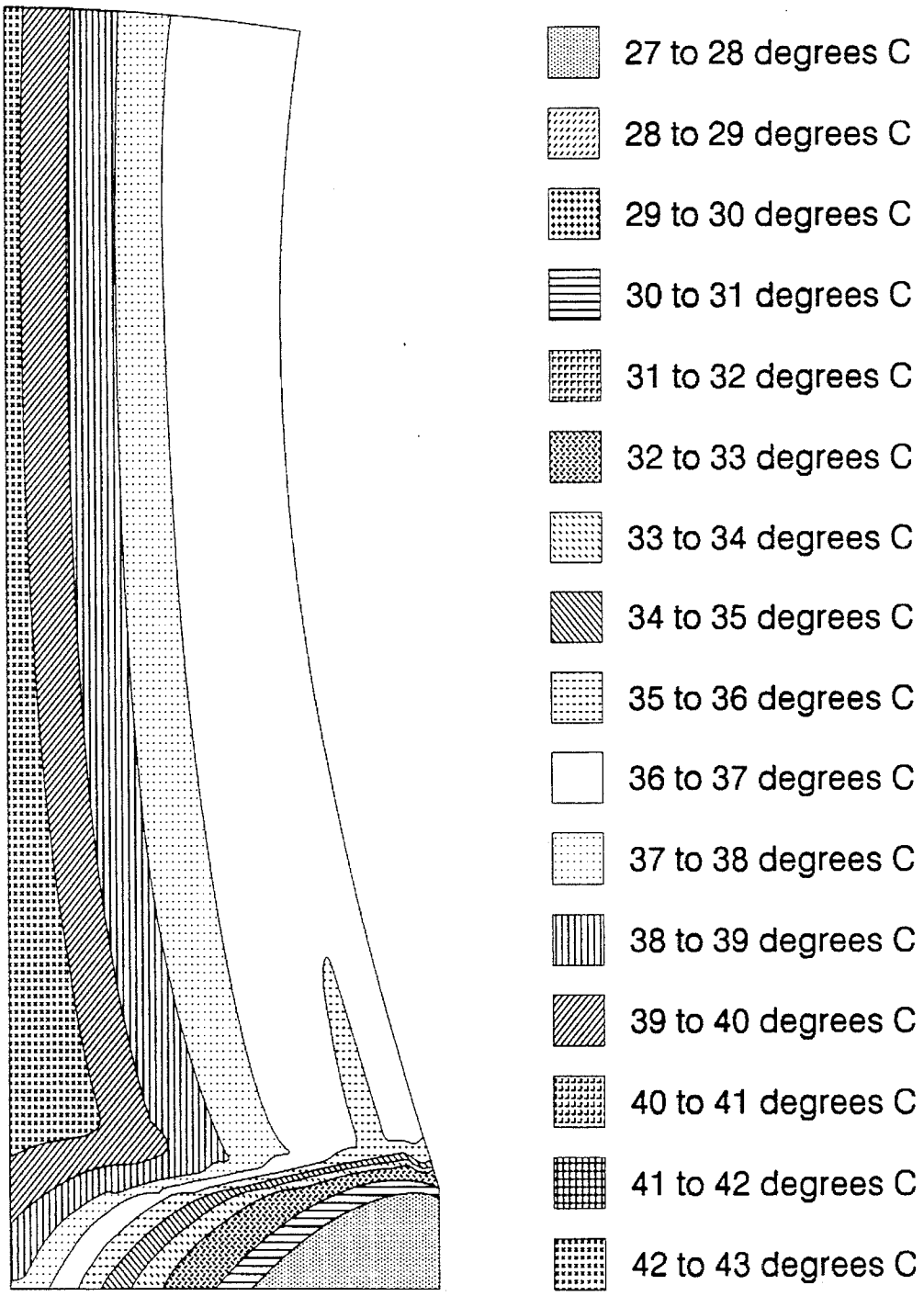
FIG. 7 is an air temperature isotherm contour radially across the draft channel of a cooling tower without the baffle/rain-shield of the present invention.

As fresh air penetrates the air inlet volume, the rainfall that heats and causes the flow direction to turn upwardly also initially slows the inlet air flow velocity by obstacle resistance. By whatever exchange mechanism among the rainfall rate, droplet distribution, inlet air volume and velocity, the draft channel outer rim annulus of air flow removes more heat from the cooling water system than does an axial core flow of air volume. With respect to the isotherm contours of FIG. 7, a gradient of 5° C. to 7° C. may occur between the 36° C. to 37° C. rim annulus temperature and a 42° C. to 43° C. core flow temperature.

To more equally match the heat absorption capacity of the inlet air volume with the heat dissipation needs of the process water cooling system, the present invention provides a baffle means 30 to channel a predetermined percentage of the inlet air flow directly to the axial core region of the venturi draft channel substantially shielded from the outer annulus rainfall. Supporting the baffle/rain-shield canopy 31 is a circular beam 32 and a plurality of columns 33. Wire rope guys 35 secured at one end to the circular beam 32 are drawn out radially from the circular beam and over an elevation post 36 to a foundation anchor 37. By another embodiment of the invention, the circular beam 32 is supported in suspension from the fill 20 supporting superstructure.

In a preferred embodiment of the invention the baffle/rain-shield canopy 31 outer edge 38 is extended radially relative to the tower axis to a point between the base edge 15 of the tower shell 12 and the footer rim 17. Vertically, the canopy edge is preferably positioned between 15% to 50% of this air entrance area height. One preferred embodiment places the canopy edge at 10 ft. above the footer rim 17 in a entrance area opening height of 40 ft. Depending on the tension drawn upon the rope guys 35, the canopy shape may be set between an approximation of a hyperboloid of revolution to a frustum of a cone. Preferably, however the guys 35 will be substantially horizontal at the canopy edge and substantially vertical at the circular beam 32. This geometry will normally define a hyperboloid of revolution except for the catenary distortion due to the cable and canopy weight distribution. It should be understood, however, that substantially effective results may be obtained by a baffle/rain-shield canopy that is substantially linear.

In the preferred embodiment with wire rope guys 35, the canopy 31 may be a durable woven fabric or fiber reinforced polymer film. For example, fabrics woven from nylon or polyaramid fiber such as Kavlar or Nomex are particularly suitable. Gore sections of such fabric or film may be assembled for either draping over the guys, 35, or suspended beneath the guys by lacing, for example.

Figure 5:
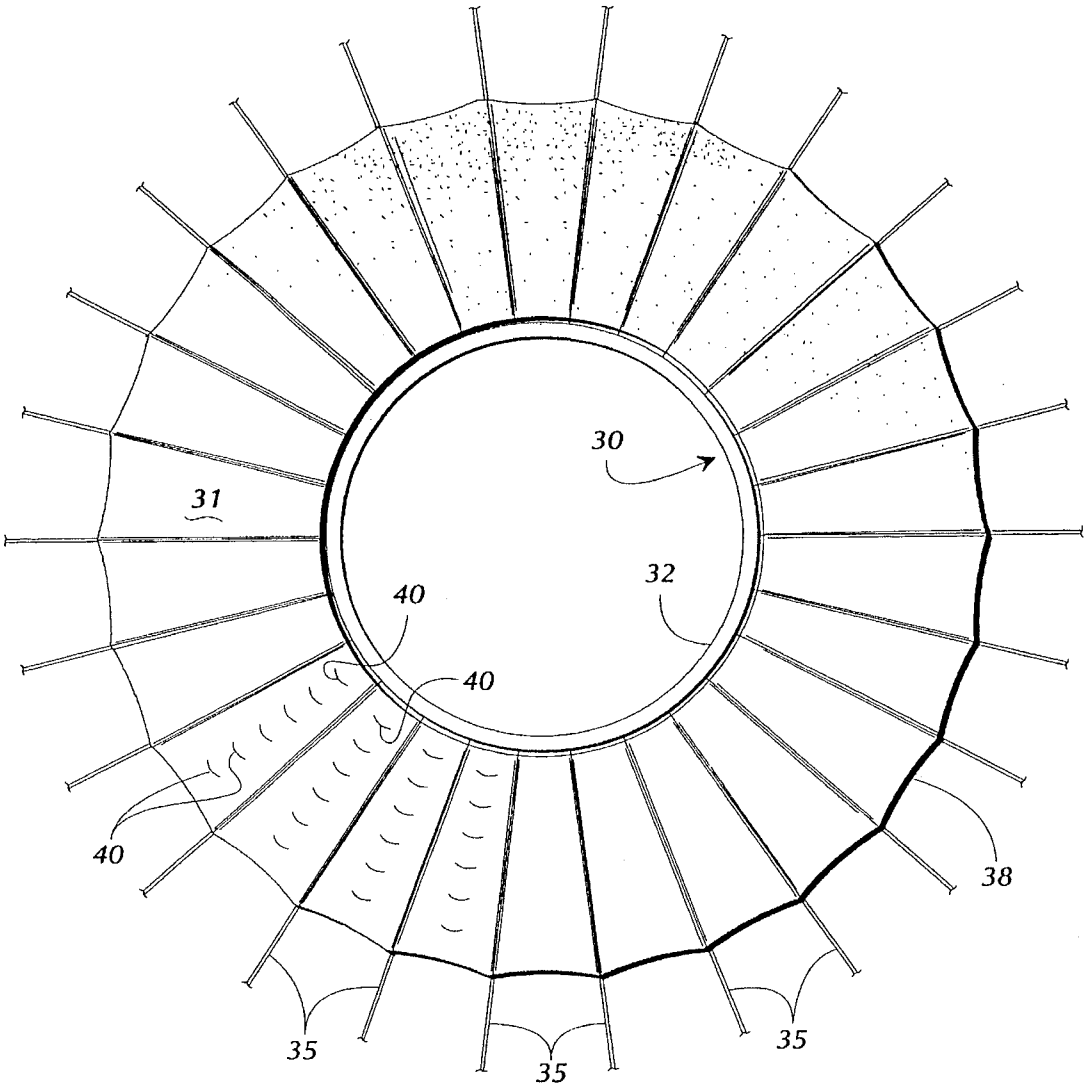
FIG. 5 is a top plan view of the baffle/rain-shield.

Along radial lines between the guys 35, the canopy gores are apertured with a series of spaced drain vents 40 as best seen at FIG. 5. These vents are aligned transversely of the radius for the purpose of draining accumulated process water across the air inlet volume in a multiplicity of riverlets aligned in radial rows to minimize inlet air flow disturbance.

Those of ordinary skill in the art will recognize that such apertures in a fabric as the vent 40 should be reinforced by one of several available means such as a buttonhole to prevent enlargement.

Although the preferred embodiment of our invention has been described with respect to a flexible fabric or film material for the canopy 31, it will be understood by those of ordinary skill in the art that the substantial equivalent may be constructed of resin impregnated fiberglass or more traditional rigid roofing construction materials and methods such as sheet metal, wood shingles, tile etc.

As is apparent from the invention structure superimposed on the known operation of a natural draft cooling tower, inlet air to the tower is divided at the entrance boundary by the outer canopy edge 31. That air above the canopy edge penetrates the air inlet volume in direct contact and heat exchange with process water rain from the outer annulus of the tower draft channel. That air below the canopy edge is substantially protected from the rain droplet dispersion of falling process water until reaching the central core of the draft channel defined by the draft channel aperture within the circular beam 32. Such protected, central core cooling air flow arrives with a lowered temperature and greater heat sink capacity to cool the central core cooling water volume.

Outer annulus cooling water falling upon the baffle/rain-shield canopy as dispersed droplets is consolidated into rivulets between the canopy support guys 35 and discharged through the transverse button-hole apertures 40 for continued free-fall into the collecting basin 25. By consolidating and aligning the outer annulus cooling water into radial rows of rivulets to cross that portion of the air inlet volume protected for central core air supply, the desired balance may be found whereat all cooling water arrives to the collecting basin 25 at substantially the same temperature thereby removing the most heat from the process water by the air volume fixed by the inlet air structural geometry.

Having fully described a preferred embodiment of our invention those of ordinary skill in the art will readily perceive obvious alternatives, equivalents and modifications. As our invention, however,

We claim:

1. A natural draft water cooling tower comprising a substantially vertical axis draft channel above an air inlet volume served by an inlet perimeter of substantially horizontally flow inlet air; hot process water dispersion means disposed within said draft channel and above said air inlet volume for direct, heat exchange contact of dispersed hot process water with air flow from said inlet air perimeter; and, baffle means disposed within said air inlet volume to divide inlet air flow between a first portion to an axial core section of said draft channel and a second portion to a substantially annular section of draft channel around said core section, said baffle means comprising a substantially annular canopy having an outer rim perimeter proximate of said inlet air perimeter and an interior aperture substantially coaxial with said axial core.

2. A water cooling tower as described by claim 1 wherein said hot water dispersion means disperses and distributes said process water across a horizontal section of said draft channel as free falling droplets.

3. A water cooling tower as described by claim 2 wherein said inlet air flow and said free falling process water droplets are in substantially counter-flowing, direct heat exchange contact.

4. A water cooling tower as described by claim 3 wherein said baffle means shields said first portion of inlet air flow from said free falling water droplets under said draft channel annular section.

5. A water cooling tower as described by claim 1 wherein said canopy outer rim perimeter is positioned at about 15% to about 50% of an inlet air perimeter height.

6. A water cooling tower as described by claim 1 wherein said baffle means further comprises a multiplicity of rope means secured at one end to and around a structural circle defining said interior aperture, said rope means being drawn radially from said interior aperture and secured to define a positional height of said canopy outer rim perimeter.

7. A water cooling tower as described by claim 6 wherein said baffle means further comprises a flexible material supported by said rope means, said flexible material being vented at readily spaced positions along substantially radial lines between said rope means.

8. A method of operating a natural draft water cooling tower having a substantially vertical axis draft channel above a substantially cylindrical air inlet volume served by a substantially circular inlet perimeter of substantially radially and horizontally flowing inlet air, said method including the steps of distributing hot process water within said air inlet volume as free falling droplets in direct contact and heat exchange with flowing inlet air and dividing said inlet air flow by a substantially continuous, horizontal dividing plane transversely across said cylindrical inlet volume between a first portion to an axial core section of said draft channel and a second portion to a substantially annular section of draft channel around said core section.

9. A method as described by claim 8 wherein said inlet air flow is divided to allocate about 15% to about 50% of said inlet air flow to said first portion.

10. A method as described by claim 8 wherein said first portion of inlet air is substantially shielded by said dividing plane from said free falling droplets in transit across said air inlet volume from said inlet perimeter.

11. A method as described by claim 10 wherein free falling droplets crossing said first inlet air flow portion of said air inlet volume are consolidated by said dividing plane into substantially radial rows of rivulets aligned with the substantially radial flow direction of said second inlet air flow portion.

* * * * *